United States Patent [19]

Palmer

[11] 4,329,247

[45] May 11, 1982

[54] STAIN REMOVER FOR VINYL MATERIALS

[75] Inventor: Lewis B. Palmer, St. Paul, Minn.

[73] Assignee: PDI, Inc., St. Paul, Minn.

[21] Appl. No.: 204,492

[22] Filed: Nov. 6, 1980

[51] Int. Cl.[3] ..... C11D 7/52; C11D 9/04

[52] U.S. Cl. ..... 252/104; 252/DIG. 8; 252/DIG. 10; 252/174.25; 134/2; 134/38; 134/40; 134/42

[58] Field of Search ..... 252/104, DIG. 8, DIG. 10, 252/174.25; 134/2, 38, 40, 42

[56] References Cited

U.S. PATENT DOCUMENTS

| | | | |
|---|---|---|---|
| 3,503,885 | 3/1970 | Wedell | 252/105 |
| 3,915,880 | 10/1975 | Sepulveda | 252/104 |
| 4,057,505 | 11/1977 | Nakagawa et al. | 252/94 |
| 4,154,695 | 5/1979 | McCrudden et al. | 252/99 |

FOREIGN PATENT DOCUMENTS 4517789 6/1970 Japan .

*Primary Examiner*—Mayer Weinblatt

*Attorney, Agent, or Firm*—Orrin M. Haugen; Thomas J. Nikolai

[57] ABSTRACT

A method and formulation for removing stains from vinyl surfaces which comprises the use of a formulation containing a solvent selected from the group consisting of ethylene glycol monoalkyl ethers and ethylene glycol monoalkyl ether acetates, along with an aqueous solution of sodium hypochlorite or calcium hypochlorite in fumed silica. The formulation is highly useful for removing stains, particularly ink and other stains applied either accidentally or as an element of graffiti on vinyl surfaces.

5 Claims, No Drawings

STAIN REMOVER FOR VINYL MATERIALS

BACKGROUND OF THE INVENTION

The present invention relates generally to the preparation of a formulation useful in the removal of stains from vinyl surfaces, and more particularly to such a formulation which is useful in the removal of ink, paint, and other materials from vinyl surfaces.

Vinyl materials are widely used on exposed external surfaces such as, for example, vinyl floor tile, painted walls, as well as certain hard plastic surfaces. Such materials are found useful, particularly because of their durability, lack of sensitivity to utraviolet solar rays, and the like. Furthermore, they are frequently used because they are light in weight, are durable, easy to apply and remove, and as such can be highly useful in such applications. Whenever exterior surfaces are exposed to the public, there is a frequent generation of graffiti on the surface which must be promptly removed. The removal of such stains, either deliberately or accidentally applied, poses a problem which is highly labor-intensive, and thus expensive to undertake and complete. The present invention relates to a formulation which has been found particularly adapted for use in removal of such stains, and wherein the labor required for removal is significantly and substantially reduced.

Essentially, the present invention involves the preparation of a formulation consisting of a solvent selected from the group consisting of ethylene glycol monoalkyl ethers and ethylene glycol monoalkyl ether acetates. In each instance, the alkyl group is one having up to 4 carbon atoms. Fumed silica is present so as to provide a working formulation which is in the form of a gel. In order to provide for a cleansing action, sodium hypochlorite or calcium hypochlorite is present as well. In order to preserve the nature of the vinyl material, and to reduce the amount of leaching of plasticizer from the vinyl, a plasticizer material, specifically a conventional vinyl plasticizer is incorporated. Surfactants may also be utilized in the working formulation, with the surfactants being either of the cationic, nonionic or polyfunctional type.

SUMMARY OF THE INVENTION

Therefore, it is a primary object of the present invention to provide an improved formulation for the removal of stains from vinyl surfaces, particularly when such stains are accidentally applied or applied as a form of graffiti, and with the formulation including a solvent selected from the group consisting of ethylene glycol monoalkyl ethers and ethylene glycol monoalkyl ether acetates along with fumed silica and sodium hypochlorite.

It is a further object of the present invention to provide an improved method and formulation for removing stains from vinyl surfaces which includes a solvent selected from the group consisting of ethylene glycol monoalkyl ethers and ethylene glycol monoalkyl ether acetates, fumed silica, and sodium hypochlorite, or calcium hypochlorite, and wherein a surfactant of the nonionic, cationic, or polyfunctional type is present along with a plasticizer to reduce the leaching of residual plasticizer in the vinyl surface.

Other and further objects of the present invention will become apparent to those skilled in the art upon a study of the following specification and appended claims.

DESCRIPTION OF THE PREFERRED EMBODIMENT

In order to provide a basis for disclosure of the various aspects of the present invention, the following specific compositions are provided:

EXAMPLE 1

| Component | Volume |
|---|---|
| A solvent consisting of ethylene glycol monoalkyl ethers having the structural formula<br>$HO-CH_2-CH_2-O-(R)$<br>wherein R represents an alkyl group having up to 4 carbon atoms; | 30% |
| Fumed silica; | 10% |
| Sodium hypochlorite (5% in water). | 60% |

This material may be utilized either in the formulation above, or diluted in a quantity of water so as to represent 5%–50% of the aqueous working solution. This material has been found effective in removing stains from vinyl surfaces.

EXAMPLE 2

| Component | Volume |
|---|---|
| A solvent consisting of ethylene glycol monoalkyl ether acetate selected from the group consisting of<br>$CH_3-\overset{\overset{\displaystyle O}{\|}}{C}-O-CH_2-O-(R_1)$<br>wherein $R_1$ represents an alkyl group having up to 4 carbon atoms; specifically ethylene glycol monobutyl ether; | 30% |
| Fumed silica; | 10% |
| Sodium hypochlorite (5% in water). | 60% |

This material may be utilized either in the formulation above, or diluted in a quantity of water so as to represent 5%–50% of the aqueous working solution. This material has been found effective in removing stains from vinyl surfaces.

EXAMPLE 3

| Component | Volume |
|---|---|
| A solvent consisting of ethylene glycol monomethyl ether having the structural formula<br>$HO-CH_2-CH_2-O-(R)$<br>wherein R represents an alkyl group having up to 4 carbon atoms; | 20% |
| Fumed silica; | 10% |
| Calcium hypochlorite (5% in | |

-continued

| Component | Volume |
|---|---|
| water). | 70% |

EXAMPLE 4

| Component | Volume |
|---|---|
| A solvent consisting of ethylene glycol monoalkyl ether acetate selected from the group consisting of | |
| $CH_3-\overset{O}{\overset{\|}{C}}-O-CH_2-O-(R_1)$ | |
| wherein $R_1$ represents an alkyl group having up to 4 carbon atoms; specifically ethylene glycol monobutyl ether acetate; | 20% |
| Fumed silica; | 10% |
| Calcium hypochlorite (5% in water). | 70% |

The calcium hypochlorite may be employed within a concentration range of from 5% to 10% in water. With the working solution being the formulation above diluted in water so as to represent between 5% and 50% of the aqueous working solution.

EXAMPLE 5

| Component | Volume |
|---|---|
| A solvent selected from the group consisting of ethylene glycol monoalkyl ethers having the structural formula | |
| $HO-CH_2-CH_2-O-(R)$ | |
| wherein R represents an alkyl group having up to 4 carbon atoms; | 45% |
| Fumed silica; | 5% |
| Sodium hypochlorite (10% in water). | 50% |

EXAMPLE 6

| Component | Volume |
|---|---|
| A first solvent component consisting of ethylene glycol monoalkyl ethers having the structural formula | |
| $HO-CH_2-CH_2-O-(R)$ | |
| wherein R represents an alkyl group having up to 4 carbon atoms; | 22% |
| a second solvent component consisting of ethylene glycol monoalkyl ether acetate selected from the group consisting of | |
| $CH_3-\overset{O}{\overset{\|}{C}}-O-CH_2-O-(R_1)$ | |
| wherein $R_1$ represents an alkyl group having up to 4 carbon atoms; specifically ethylene glycol monobutyl ether; | 40% |
| Fumed silica; | 8% |
| Sodium hypochlorite (10% in water). | 30% |

EXAMPLE 7

| Component | Volume |
|---|---|
| A first solvent component consisting of ethylene glycol monoalkyl ethers having the structural formula | |
| $HO-CH_2-CH_2-O-(R)$ | |
| wherein R represents an alkyl group having up to 4 carbon atoms; | 20% |
| a second solvent component consisting of ethylene glycol monoalkyl ether acetate selected from the group consisting of | |
| $CH_3-\overset{O}{\overset{\|}{C}}-O-CH_2-O-(R_1)$ | |
| wherein $R_1$ represents an alkyl group having up to 4 carbon atoms; specifically ethylene glycol monobutyl ether; | 5% |
| Fumed silica; | 5% |
| Calcium hypochlorite (10% in water). | 70% |

EXAMPLE 8

| Component | Volume |
|---|---|
| Calcium hypochlorite (10% in water) | 20% |
| Ethylene glycol monobutyl ether (Butyl Cellosolve) | 80% |

EXAMPLE 9

| Component | Volume |
|---|---|
| Sodium hypochlorite (5% in water) | 70% |
| Ethylene glycol monomethyl ether acetate (Butylacetate) | 30% |

EXAMPLE 10

| Component | Volume |
|---|---|
| Sodium hypochlorite (5% in water) | 40% |
| Ethylene glycol monobutyl ether acetate (Butylacetate) | 60% |

GENERAL DISCUSSION

By way of general discussion, the individual components will be described briefly hereinbelow. The individual components from the formulations will be discussed separately, one from the other.

The Solvent System

As indicated above, the solvent system is one which is selected from the group consisting of ethylene glycol monoalkyl ethers and ethylene glycol monoalkyl ether acetates, wherein the ethylene glycol monoalkyl ethers have the structural formula:

$$HO—CH_2—CH_2—O—(R)$$

and wherein the ethylene glycol monoalkyl ether acetates have the structural formula:

$$CH_3—\overset{\overset{\displaystyle O}{\|}}{C}—O—CH_2—O—(R_1)$$

These materials are readily commercially available, with one of the preferred materials being ethylene glycol monobutyl ether, commonly known as Butyl Cellosolve. The materials indicated are commercially available, with the ethylene glycol monomethyl ether and its acetate being readily commercially available as well. Mixtures of such solvents may be employed. This component of the formulation is preferably present in a range of from 20% to 80%. In certain applications, mixtures of Butyl Cellosolve and butylacetate may be employed, with these mixtures being suitable in any relative ratio.

Fumed Silica

Fumed silica is commercially available, and is provided in the formulation to form a gel in the working material. Fumed silica is commercially available under the code designation "Cab-O-Sil" from the Cabot Corporation of Boston, Mass. The fumed silica may be employed in a range of from between about 3% and 20%.

Sodium Hypochlorite

Sodium hypochlorite, normally available as household bleach, is sold commercially in an aqueous solution containing from 5% to 10% of sodium hypochlorite. Such materials are, of course, widely commercially available. As an alternate to sodium hypochlorite, calcium hypochlorite may be employed in either dry form or premixed with water at a concentration of from between about 5% and 15%. In the actual formulations, either calcium hypochlorite or sodium hypochlorite may be employed premixed with water at a concentration range of between 5% and 15%, with the premixture being contained in the finished material in a range of from between about 20% and 80%.

Surfactant

Surfactants are utilized to enhance the cleaning capability of the formulations. Those surfactants most desirable in the formulation include cationic, nonionic, and polyfunctional surfactants, with the surfactants being contained in the formulations in a range of from between about 0.1% and 2%. Examples of such materials, all of which are commercially available, are the following:

(A) Cationics

Retzamines Nos. 194, 209, 211, and 357, all of which are available from Witco Chemical Corp., Organics Division, of New York, N.Y. These materials are the fatty aminodiamines, including 1-aminoethyl glyoxaladine, mixed glyoxaladines, and 1-hydroxyethyl-2-glyoxaladine respectively. Other cationic surfactants are useful as well.

(B) Nonionics

With respect to nonionic surfactants, those certain materials known as Pluronic, such as Pluronic 10R8, 17R8, F38, F68, F88, L31, L35, and the like may be utilized. The Pluronic materials are, generally, a series of condensates of ethylene oxide with hydrophobic bases formed by condensing propylene oxide with propylene glycol.

(C) Polyfunctionals

With respect to polyfunctional surfactants, various of these materials are commercially available, with one such material being known as "Monaterics", available from Mona Industries, Inc. of Patterson, N.J. "Monaterics" are generally described as a series of carboxylic acid derivatives of substituted imidazolines.

Plasticizer

In order to either reduce or compensate for the leaching of plasticizer from the vinyl surface, the following plasticizers may be added to the formulation:

Dioctylphthalate;

Adipate esters selected from the group consisting of diisooctyl adipate; dibutoxyethyl adipate; diisobutyl adipate; di-2-ethylenehexyl adipate; n-octyl n-decyl adipate; di-isodecyl adipate;

Organic phosphates and tribasic lead maleate.

These plasticizers may be added to the formulations of Examples 1–10 above, in a range from between about 1% to 50% by weight. The materials indicated have been found to be substantially interchangeable, one with the other, in the formulations of Examples 1–10 above.

Stabilizer

If desired, a stabilizer may be added to the solution in order to restabilize the vinyl surface being cleaned against further attack from ultraviolet radiation, or to retard deterioration due to oxidation. Such stabilizers or antioxidents may be used in a range of from about one-tenth percent to about 3% of the system components. Examples of such stabilizers or antioxidants are as follows:

2(2′-hydroxy-5′-methyl phenyl) benzotriazole—these materials are described in detail in U.S. Pat. Nos. 3,189,615 and 3,004,896;

tetrakis [methylene 3-(3′,5′-di-t-butyl-4′-hydroxyphenyl)propionate]methane;

octadecyl 3-(3′,5′-di-tert-butyl-4′-hydroxyphenyl)propionate;

o,o-di-n-octadecyl-3,5-di-tert-butyl-4 hydroxy benzyl phosphonate—this material is described in U.S. Pat. Nos. 3,281,505 and 3,367,870;

2-(3′,5′-ditert-butyl-2′-hydroxy-phenyl)-5-chlorobenzotriazole—this material is described in U.S. Pat. Nos. 3,004,896 and 3,189,615;

2-(3′-tert-butyl-2′-hydroxy-5′-methylphenyl)-5-chlorobenzotriazole—this material is described in U.S. Pat. Nos. 3,004,896 and 3,189,615.

METHOD OF UTILIZATION

The materials as set forth above are utilized in a conventional gel solution, and may be used by merely applying to the surface by a spatula or the like. The ink, paint, or other stain is readily removed from the vinyl surface and the surface is accordingly cleaned, polished, and stabilized.

The system is primarily intended for use in concentrated or undiluted form, although a working aqueous solution may be employed if desired. When water is used, the working solution contains 5%–95% of the formulation set forth in Examples 1–10, balance water. Also, in the aqueous working solutions, plasticizers and surfactants are preferably present, in the ranges set forth hereinabove.

I claim:

1. A stain remover for vinyl surfaces consisting of a formulation having the following composition:

| Component | Volume [Percent] |
|---|---|
| (a) A solvent selected from the group consisting of ethylene glycol monoalkyl ethers having the structural formula $HO—CH_2—CH_2—O—(R)$ wherein R represents an alkyl group having up to 4 carbon atoms; ethylene glycol monoalkyl ether acetate selected from the group consisting of $CH_3—\overset{\overset{O}{\|}}{C}—O—CH_2—O—(R_1)$ | |

-continued

| Component | Volume [Percent] |
|---|---|
| wherein $R_1$ represents an alkyl group having up to 4 carbon atoms; selected from the group consisting of [specifically] ethylene glycol monobutyl ether and mixtures thereof; | 5%–80% |
| (b) Fumed silica; | 5%–20% |
| (c) Calcium hypochlorite or sodium hypochlorite (5% to 10% solution in water). | 5%–20% |

2. The composition as defined in claim 1 wherein said solvent is ethylene glycol monobutyl ether.

3. The composition as defined in claim 1 wherein said formulation is present in an aqueous working solution of up to 95% water.

4. The composition as defined in either claims 1 or 3 and containing a surfactant selected from the group consisting of cationic, nonionic, and polyfunctional surfactants, and wherein the polyfunctional surfactant is a carboxylic acid derivative of substituted imidazoline.

5. The composition as defined in either claims 1 or 3 and containing up to 50% by weight of a plasticizer selected from the group consisting of dioctylphthalate, adipate esters, and tribasic lead maleate, and wherein said adipate esters are selected from the group consisting of diisooctyl adipate; dibutoxyethyl adipate; diisobutyl adipate; di-2-ethylenehexyl adipate; n-octyl n-decyl adipate; and di-isodecyl adipate.

* * * * *

UNITED STATES PATENT AND TRADEMARK OFFICE

CERTIFICATE OF CORRECTION

PATENT NO. : 4,329,247
DATED : May 11, 1982
INVENTOR(S) : Lewis B. Palmer

It is certified that error appears in the above-identified patent and that said Letters Patent are hereby corrected as shown below:

Column 7, Line 19, "[Percent]" should be deleted.

Column 8, Line 2, "[Percent]" should be deleted.

Column 8, Line 6, "[specifically]" should be deleted.

Signed and Sealed this

*Twentieth* Day of *July 1982*

[SEAL]

*Attest:*

GERALD J. MOSSINGHOFF

*Attesting Officer*

*Commissioner of Patents and Trademarks*